US005592525A

United States Patent [19]

Reznikov et al.

[11] Patent Number: 5,592,525

[45] Date of Patent: Jan. 7, 1997

[54] METHOD FOR MAKING A ROTATING ANODE WITH AN INTEGRAL SHAFT

[75] Inventors: Gregory Reznikov, Akron; Peter Eloff, Cleveland Hts., both of Ohio; Thomas Tiearney, Waukesha, Wis.

[73] Assignee: General Electric Company, Milwaukee, Wis.

[21] Appl. No.: 347,534

[22] Filed: Nov. 30, 1994

[51] Int. Cl.[6] ..... H01J 35/10

[52] U.S. Cl. ..... 378/121; 378/144

[58] Field of Search ..... 378/121, 125, 378/127, 128, 131, 143, 144

[56] References Cited

U.S. PATENT DOCUMENTS

| | | | |
|---|---|---|---|
| 3,622,824 | 11/1971 | Atlee | 378/144 X |
| 3,836,805 | 9/1974 | Kok | 378/144 X |
| 4,145,632 | 3/1979 | Devine, Jr. | 378/144 |
| 4,876,705 | 10/1989 | Delair et al. | 378/144 |
| 4,920,551 | 4/1990 | Takahashi et al. | 378/144 |
| 5,208,843 | 5/1993 | Marumo et al. | 378/144 X |

FOREIGN PATENT DOCUMENTS

| | | | |
|---|---|---|---|
| 231581 | 2/1964 | Austria | 378/144 |

*Primary Examiner*—David P. Porta
*Attorney, Agent, or Firm*—B. Joan Haushalter; John H. Pilarski

[57] ABSTRACT

A method for making a rotating X-ray tube provides a rotating anode having an integral stem. Initially, a cathode which emits electrons is provided. Next, a preheated anode target which radiates x-ray in response to bombardment by the electrons is provided. The method further comprises the steps of providing an anode stem and inertia welding the preheated anode target to the anode stem to form a rotating anode with an integral stem.

3 Claims, 2 Drawing Sheets

METHOD FOR MAKING A ROTATING ANODE WITH AN INTEGRAL SHAFT

TECHNICAL FIELD

The present invention relates to rotating X-ray tubes and, more particularly, to rotating X-ray tubes which employ a rotating anode assembly having an integral stem.

BACKGROUND ART

The x-ray tube has become essential in medical diagnostic imaging, medical therapy, and various medical testing and material analysis industries. Typical x-ray tubes are built with a rotating anode structure for the purpose of distributing the heat generated at the focal spot. The anode is rotated by an induction motor consisting of a cylindrical rotor built into a cantilevered axle that supports the disc shaped anode target, and an iron stator structure with copper windings that surrounds the elongated neck of the x-ray tube that contains the rotor. The rotor of the rotating anode assembly being driven by the stator which surrounds the rotor of the anode assembly is at anodic potential while the stator is referenced electrically to ground. The X-ray tube cathode provides a focused electron beam which is accelerated across the anode-to-cathode vacuum gap and produces X-rays upon impact with the anode.

In an x-ray tube device with a rotatable anode, the target consists of a disk made of a refractory metal such as tungsten, and the x-rays are generated by making the electron beam collide with this target, while the target is being rotated at high speed. Rotation of the target is achieved by driving the rotor provided on a support shaft extending from the target. Such an arrangement is typical of rotating X-ray tubes and has remained relatively unchanged in concept of operation since its introduction. However, the operating conditions for x-ray tubes have changed considerably in the last two decades. U.S. Pat. No. 4,119,261, issued Oct. 10, 1978; and U.S Pat. No. 4,129,241, issued Dec. 12, 1978, both were devoted to joining rotating anodes made from molybdenum and molybdenum-tungsten alloys to stems made from columbium and its alloys. Continuing increases in applied energy during tube operation have led to a change in target composition to TZM alloys, to increased target diameter and weight, as well as to the use of graphite as a heat sink in the back of the target. These qualitative design changes no longer permit the use of columbium stems, since such a construction would soften during the post-inertia welding process steps, such as coating or brazing.

It would be desirable then to have an improved stem design for a rotating anode of an x-ray tube.

SUMMARY OF THE INVENTION

The present invention provides an improved stem design for a rotating anode of an x-ray tube wherein the stem is integral with the anode. The present invention improves the method of joining target and stem, made from TZM alloys.

In accordance with one aspect of the present invention, a method for making an X-ray tube having a rotating anode assembly comprises the steps of providing a cathode which emits electrons and providing an anode target which radiates x-ray in response to bombardment by the electrons. The method further comprises the steps of providing an anode stem and inertia welding the anode target to the anode stem to form a rotating anode with an integral stem.

Accordingly, it is an object of the present invention to provide a rotating anode structure for an x-ray tube. It is a further object of the present invention to provide the rotating anode with an integral stem. It is yet another object of the present invention to provide such a rotating anode and integral stem that is particularly adaptable wherein the x-ray tube target has increased diameter and weight and further has a TZM alloy composition.

Other objects and advantages of the invention will be apparent from the following description, the accompanying drawings and the appended claims.

DETAILED DESCRIPTION OF THE PREFERRED EMBODIMENTS

The present invention relates to rotating X-ray tubes which employ a rotating anode assembly and a cathode assembly. The purpose of this invention is to improve the method of joining target and stem, where the stem and the target are made from TZM alloy. In accordance with the present invention, the TZM alloy comprises molybdenum, and approximately 0.5% titanium, 0.1% zirconium, and 0.05% carbon.

Figure 1:
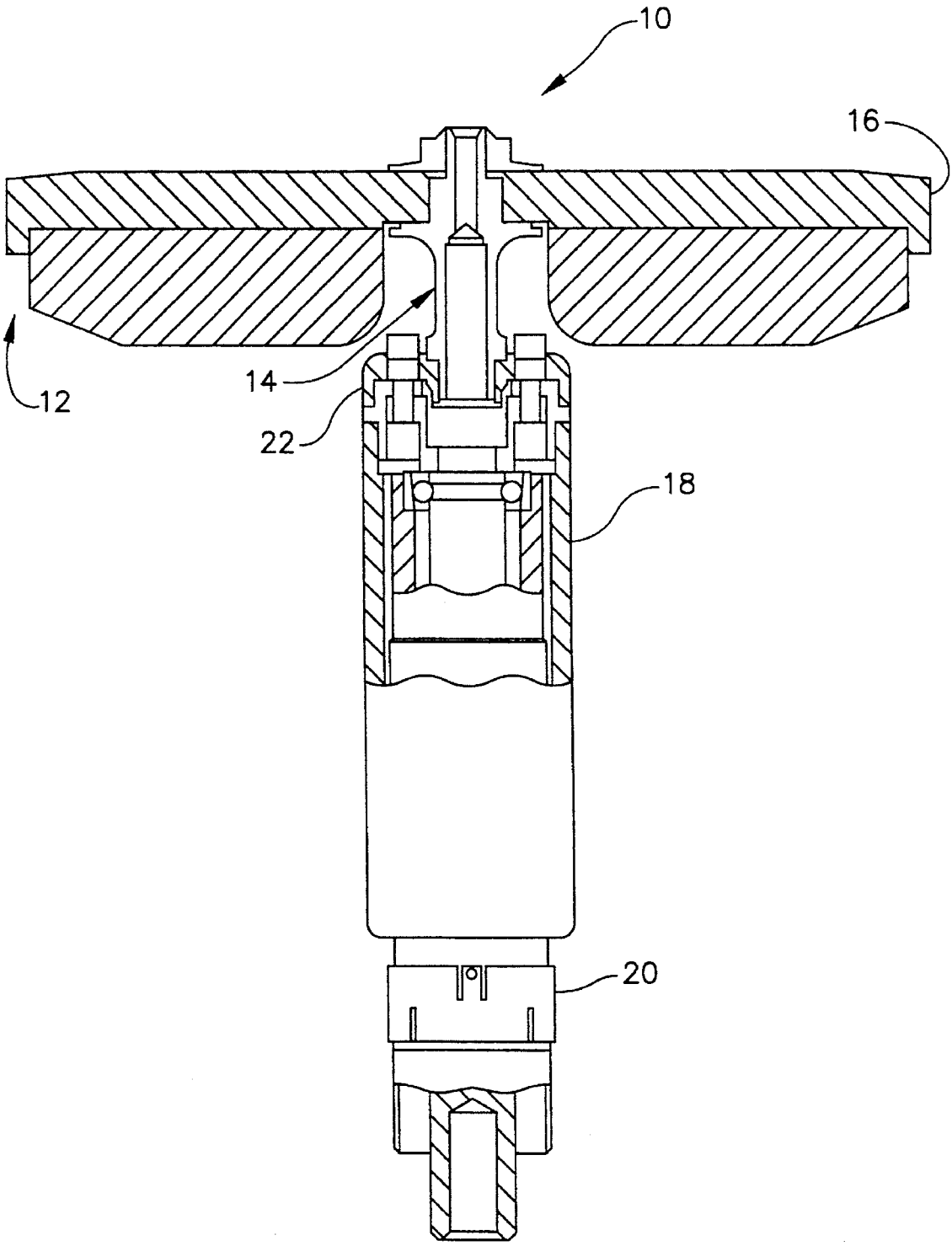
FIG. 1 (PRIOR ART)
FIG. 1 is a prior art cross-sectional illustration of a typical X-ray tube.

Referring now to the drawings, FIG. 1 illustrates a typical prior art X-ray tube 10. The X-ray tube 10 is typically built with a rotating anode assembly 12, with an associated stem 14, for the purpose of distributing the heat generated at a focal spot. The anode assembly 12 comprises a target 16 and a rotor 18, also at anodic potential. A typical X-ray tube 10 further comprises an X-ray tube cathode assembly (not shown) for providing a focused electron beam which is accelerated across a large anode-to-cathode vacuum gap and producing X-rays upon impact with the anode.

Continuing with FIG. 1, the anode assembly 12 is rotated by an induction motor comprising the cylindrical rotor 18 built around a cantilevered axle 20. The cantilevered axle 20 supports the disc shaped anode target 16 connected via a stub and hub 22 to rotor 18 and cantilevered axle 20, which contains bearings facilitating rotation. The rotor 18 of the rotating anode assembly 12, driven by a stator of the induction motor, is at anodic potential while the stator is referenced electrically to ground.

In a typical assembly, the anode assembly and a cathode assembly are sealed in a glass frame and mounted in a conductive metal housing. An insulation material is provided between the stator, and the glass frame and rotor.

Figure 2:
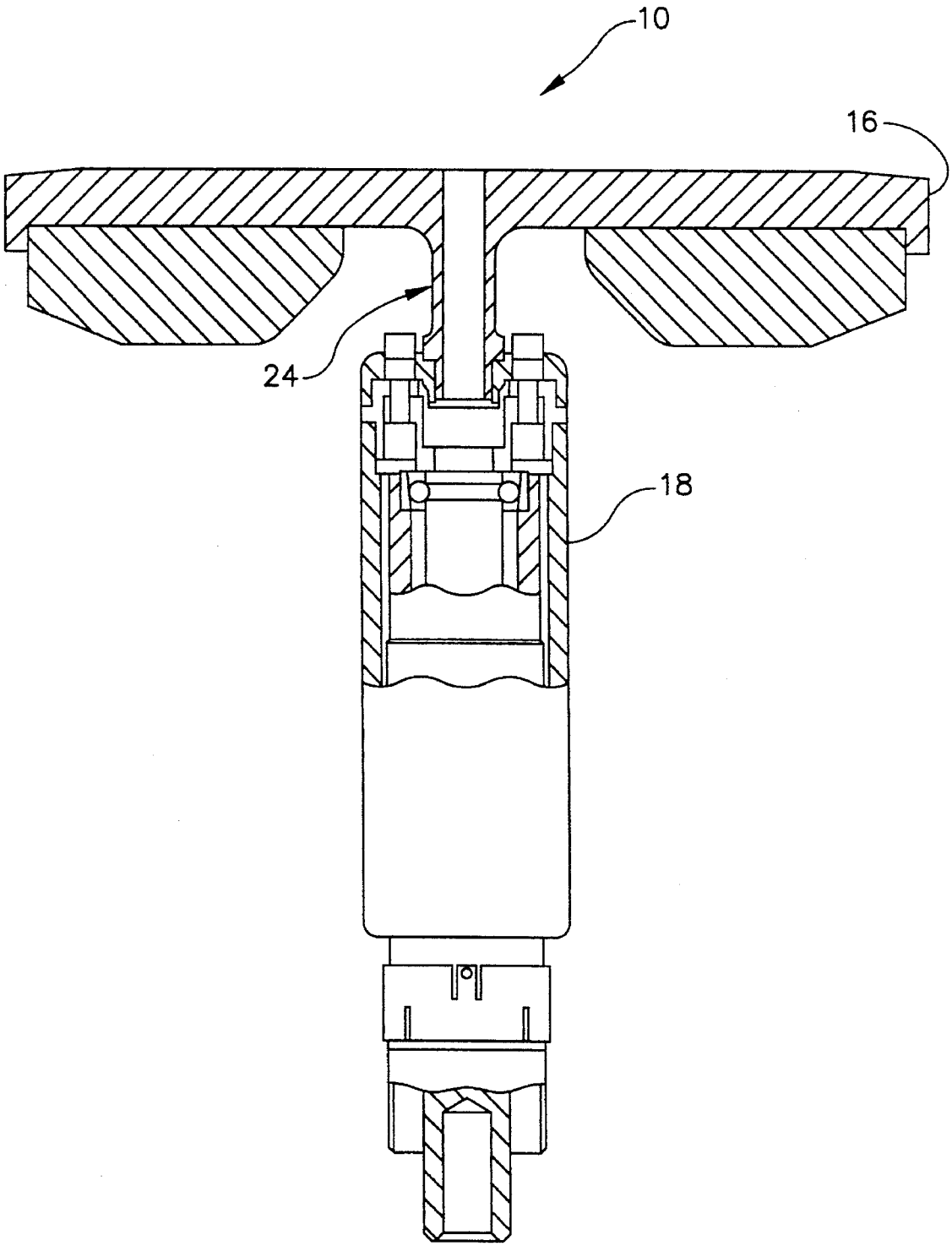
FIG. 2 is a cross-sectional view of an X-ray tube constructed in accordance with the present invention.

Referring now to FIG. 2, the present invention provides for a significant improvement in the joining of the target and stem. The target and anode stem are integral, as indicated by reference number 24, which references the anode stem and integral portion of the target. In accordance with a preferred embodiment of the present invention, an inertia welding technique is used to inertia weld a preheated anode target to the anode stem to form a rotating anode with an integral stem. The targets are preferably preheated in an electric furnace to approximately 200 to 400 C. prior to inertia welding. The welded target-stem assembly 24 then undergoes a heat treatment. The assembly 24 is then machined to the desirable configuration.

The present invention provides for improved tensile and bending strength of weldment, exceeding that of previously used metals. This attachment is metallurgically sufficient to withstand either black oxide coating or brazing of graphite to the back of the target at 1600–1800 C.

It will be obvious to those skilled in the art that various modifications and variations of the present invention are possible without departing from the scope of the invention, which provides a method for making a rotating anode with an integral stem.

The invention has been described in detail with particular reference to certain preferred embodiments thereof, but it will be understood that modifications and variations can be effected within the spirit and scope of the invention.

We claim:

1. An X-ray tube comprising:

an anode assembly;

a cathode which emits electrons;

an anode target which radiates x-ray in response to bombardment by the electrons;

an anode stem;

attachment means for integrally attaching the anode target to the anode stem to form an integral anode target and stem assembly.

2. An X-ray tube as claimed in claim 1, wherein the attachment means for integrally attaching the anode target to the anode stem comprises inertia welding means.

3. An X-ray tube as claimed in claim 2 wherein the inertia welding means comprises inertia welding means for forming a rotating anode with an integral stem.

* * * * *